US010611512B2

(12) United States Patent
Bayer et al.

(10) Patent No.: US 10,611,512 B2
(45) Date of Patent: Apr. 7, 2020

(54) SNACK FOOD CONTAINER

(71) Applicant: Frito-Lay North America, Inc., Plano, TX (US)

(72) Inventors: Johannes Bayer, Brooklyn, NY (US); Martin Bernhard Dierl, Allen, TX (US); Eduard Edwards, Arlington, TX (US); Niklas Gustafsson, Plano, TX (US); David Lestage, McKinney, TX (US); Sunitha Nair, Dallas, TX (US); Bich-Van Pham, Plano, TX (US); Stephen Tyner, Dallas, TX (US); Patrick Ryan Windley, Frisco, TX (US)

(73) Assignee: Frito-Lay North America, Inc., Plano, TX (US)

( * ) Notice: Subject to any disclaimer, the term of this patent is extended or adjusted under 35 U.S.C. 154(b) by 587 days.

(21) Appl. No.: 14/988,386

(22) Filed: Jan. 5, 2016

(65) Prior Publication Data

US 2016/0130029 A1 May 12, 2016

Related U.S. Application Data

(63) Continuation-in-part of application No. 14/446,094, filed on Jul. 29, 2014.

(51) Int. Cl.
*B65D 5/06* (2006.01)
*B65D 5/02* (2006.01)
(Continued)

(52) U.S. Cl.
CPC ..... *B65D 5/068* (2013.01); *B65D 5/029* (2013.01); *B65D 5/4208* (2013.01);
(Continued)

(58) Field of Classification Search
CPC ..... B65D 5/068; B65D 5/029; B65D 5/008; B65D 5/4266; B65D 5/4279;
(Continued)

(56) References Cited

U.S. PATENT DOCUMENTS 2,143,646 A * 1/1939 Chapman ..... B65D 5/029 229/243
3,079,062 A 2/1963 Craddock et al.
(Continued)

FOREIGN PATENT DOCUMENTS

DE 7506481 U 7/1975
DE 7838633 5/1979
(Continued)

OTHER PUBLICATIONS

EP 1103472 Espacenet Translation.*
(Continued)

*Primary Examiner* — Erik Kashnikow
*Assistant Examiner* — Ashley Axtell
(74) *Attorney, Agent, or Firm* — Barnes & Thornburg LLP; G. Peter Nichols

(57) ABSTRACT

A snack food container having a square base, side walls substantially consisting of four right triangular panels and two isosceles triangular panels, and a flat, two dimensional end seal. The container is opened by use of a tear feature just below the end seal. The container is of paperboard construction and is resealable by virtue of a score line on each side of the container located below the end seal in combination with a horizontal cut through the container located below one score line. After opening, the container can be resealed by folding the container over the score lines towards the horizontal cut. An edge of the container is then secured in the horizontal cut.

26 Claims, 14 Drawing Sheets

(51) Int. Cl.

| | |
|---|---|
| ***B65D 77/12*** | (2006.01) |
| ***B65D 5/42*** | (2006.01) |
| ***B65D 5/56*** | (2006.01) |
| ***B65D 5/62*** | (2006.01) |
| *B65B 43/10* | (2006.01) |
| *B65B 61/18* | (2006.01) |

(52) U.S. Cl.
CPC ..... *B65D 5/4266* (2013.01); *B65D 5/62* (2013.01); *B65D 77/12* (2013.01); *B65B 43/10* (2013.01); *B65B 61/18* (2013.01)

(58) Field of Classification Search
CPC ..... B65D 5/2042; B65D 5/2033; B65D 5/56; B65D 5/02; B65D 5/0005; B65D 5/6635; B65D 5/106; B65D 5/62; B65D 77/12; B65B 61/18; B65B 43/10
USPC ..... 426/106; 229/108, 115, 116, 1; 383/86.1, 88
See application file for complete search history.

(56) References Cited

U.S. PATENT DOCUMENTS

| | | | | |
|---|---|---|---|---|
| 3,224,640 | A * | 12/1965 | Schneider | B65D 31/12 222/107 |
| 3,339,721 | A | 9/1967 | Goldstein | |
| 4,139,642 | A | 2/1979 | Hix et al. | |
| 4,191,324 | A | 3/1980 | Kitagawa | |
| 4,260,097 | A | 4/1981 | Nold | |
| 5,228,782 | A * | 7/1993 | Imer | B65D 75/5822 383/200 |
| 6,213,387 | B1 | 4/2001 | Zinke | |
| D551,967 | S | 10/2007 | Hengami | |
| 9,643,755 | B2 | 5/2017 | Dunkle et al. | |
| 2004/0006950 | A1 | 1/2004 | Knoerzer | |
| 2005/0069610 | A1 | 3/2005 | Connolly et al. | |
| 2008/0023534 | A1 * | 1/2008 | Huth | B65D 5/068 229/216 |
| 2011/0297680 | A1 | 12/2011 | Howell et al. | |
| 2012/0258214 | A1 | 10/2012 | Sagel | |

FOREIGN PATENT DOCUMENTS

| | | | | |
|---|---|---|---|---|
| DE | 29614574 | U1 | 1/1997 | |
| EP | 1103472 | A2 * | 5/2001 | B65D 5/029 |
| EP | 2592017 | A1 | 5/2013 | |
| GB | 2279939 | | 1/1995 | |
| JP | S5598712 | U | 7/1980 | |
| WO | WO 96/22230 | | 7/1996 | |

OTHER PUBLICATIONS

DE 7838633 Espacenet Translation.*
Different perspective views of a Crest toothpaste box from Japan (17 pages).
PCT International Search Report and Written Opinion for PCT/US15/42705 dated Nov. 4, 2015, 8 pages.

* cited by examiner

SNACK FOOD CONTAINER

CROSS-REFERENCE TO RELATED APPLICATION

This application is a continuation-in-part (CIP) of U.S. application Ser. No. 14/446,094 filed Jul. 29, 2014, entitled "Snack Food Container," the technical disclosure of which is hereby incorporated by reference in its entirety.

BACKGROUND OF THE INVENTION

Technical Field

The present invention relates to a snack container with a three dimensional base and a two dimensional top. Specifically, the invention relates to, in a preferred embodiment, an interior-lined paperboard container filled with a snack food product that is sealed with a flat, two dimensional, seal at the top of the container yet has a square, three dimensional base, such as a square base. Such container is suitable for display on, for example, wire display racks in a convenience store setting. It is also shaped such that it fits into a standard car cup holder and is easy to hold. The container opens by use of a tear strip or tear feature slightly below the top of the container that removes the container top and allows for easy access to the snack food contained therein and a natural reclose functionality due to the container geometry.

Description of Related Art

Snack foods (such as potato or tortilla chips or crisps, nuts, popcorn, and other bite-sized savory snacks) are typically packaged in flexible bags called pillow bags. Pillow bags are suitable for display on wire racks, as they can be easily attached to the rack by a clip on the top seal of the pillow bag or by inserting a wire display rod through a hole in the top seal. This attribute can also allow for vending in vending machines that use wire hangers. Because pillow bags are flexible, however, they are not conducive to protecting the product once the bag is opened and the gas pressure inside the pillow bag is released. Pillow bags are also not shaped for use with certain convenience accessories such as a cup holder in an automobile or a cup holder in a seat at an entertainment venue (ballpark, movie theater, etc.). Pillow bags also do not naturally reclose once they are opened. A pillow bag typically requires some type of external clip to close the bag such that the product does not fall out of the bag if the bag falls on its side.

Another container typically used for snacks is a paperboard rectangular container such as traditionally used for Cracker Jack® and other similar products. These rectangular paperboard containers have the benefit of protecting the product even after the container has been opened. The container also allows for package to mouth consumption of the product contained therein. However, such paperboard rectangular containers cannot be displayed in the same manner as a pillow bag, because such containers do not have a flat or two dimensional top seal nor do they typically have a hole through the top through which a display rod can be inserted to hang the package for retail display. The rectangular boxes, depending on the dimensions, are also not typically suitable for use with cup holders. The paperboard rectangular container further typically requires a folding or manipulation of the top to reseal the container.

Another container used in the snack industry is the cylindrical container with a top cap seal, such as is used for the Lay's Stax® chip product. As with the rectangular paperboard container, the cylindrical container, typically made either of a plastic material or paperboard material, readily protects the product even after the cylinder has been opened at the top. The cylindrical container is suitable for use with cup holders and works well with one-hand use. However, the cylindrical container cannot typically be displayed on the wire racks used for pillow bag display, since the cylindrical container has neither a two dimensional top seal nor a hole through which a display rod can be inserted. Also, the cylindrical container requires a manual application of a top cap in order to reseal the container.

A need exists, therefore, for a snack container, for use with savory or sweet food products, that can be displayed on a wire display rack in a retail setting or hung in a vending machine, just like a pillow bag and yet that comprises the rigidity of a paperboard or plastic container for protecting the product. Further, such container should be suitable for use with cup holders and fit ergonomically into the human hand for one-hand use once opened and package to mouth consumption of the product contained therein. Further, the container should be designed to naturally reclose without the need for folding or the application of an external clip or top cap. Such container should be capable of carrying graphics on the exterior and have interior barrier properties sufficient to protect the snack product and promote shelf stability.

Further, a need exists for such container to incorporate a reclose feature. Such reclose feature should secure the contents of the container after opening. Ideally, such reclose feature should be integral to the container and simple to deploy.

SUMMARY OF THE INVENTION

In a preferred embodiment, the invention uses a paperboard construction lined on the interior of the container with a barrier material, typically a combination of a low density polyethylene base layer with aluminum foil or some other metalized layer, thus promoting shelf stability of the product contained therein. The container comprises a relatively square base that transitions through a geometric design utilizing folds and creases to a flat two dimensional top seal. The term "fold" or "folds" used herein means a bend in the material of greater than 89 degrees. The term "crease" or "creases" used herein means a bend in the material of less than 90 degrees.

This transition from a three dimensional base to a two dimensional top is accomplished by two opposed folds running vertically along opposite edges of the container from opposite corners of the square base to opposite edges of the top seal. Disposed between these two folds are two "V" shaped creases which start at opposite corners of the square base and terminate at a point below the top seal at each of the previously mentioned folds. This gives rise to a container that has side walls shaped of four right triangles divided by two isosceles triangles all below the point where the "V" shaped creases intersect with the folds below the top seal.

Further, in a preferred embodiment, a horizontal tear feature is constructed just below the top seal in order to open the container and remove the top seal. Once this happens, the container can be squeezed from the folds, opening the mouth of the container and allowing for access to the snack product contained therein and direct package to mouth consumption. Because of the geometry of the construction, the container substantially recloses once the pressure on the folds ceases.

In a preferred embodiment the container is of such dimensions that it easily fits in a cup holder and ergonomically fits well within the human hand for one hand use. The use of an end seal at the top allows for the retail display of the container in a similar fashion to that used for pillow bags in both retail settings and vending machines. Specifically, in one embodiment a hole or opening is fashioned in the center of the top seal such that the container can be hung off a rod on a wire display by pushing the rod through the hole. The flat end seal also allows the container to be hung on displays using clips.

A further embodiment of the container incorporates an integral reclose feature that is simple to deploy. The reclose feature utilized two diagonal score lines located below the end seal, one score line on each side of the container. After the container is opened, it can be resealed by folding the container over the score lines towards a cut through the container located on the front of the container. An edge of the container is then inserted in this cut, thereby sealing the container.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
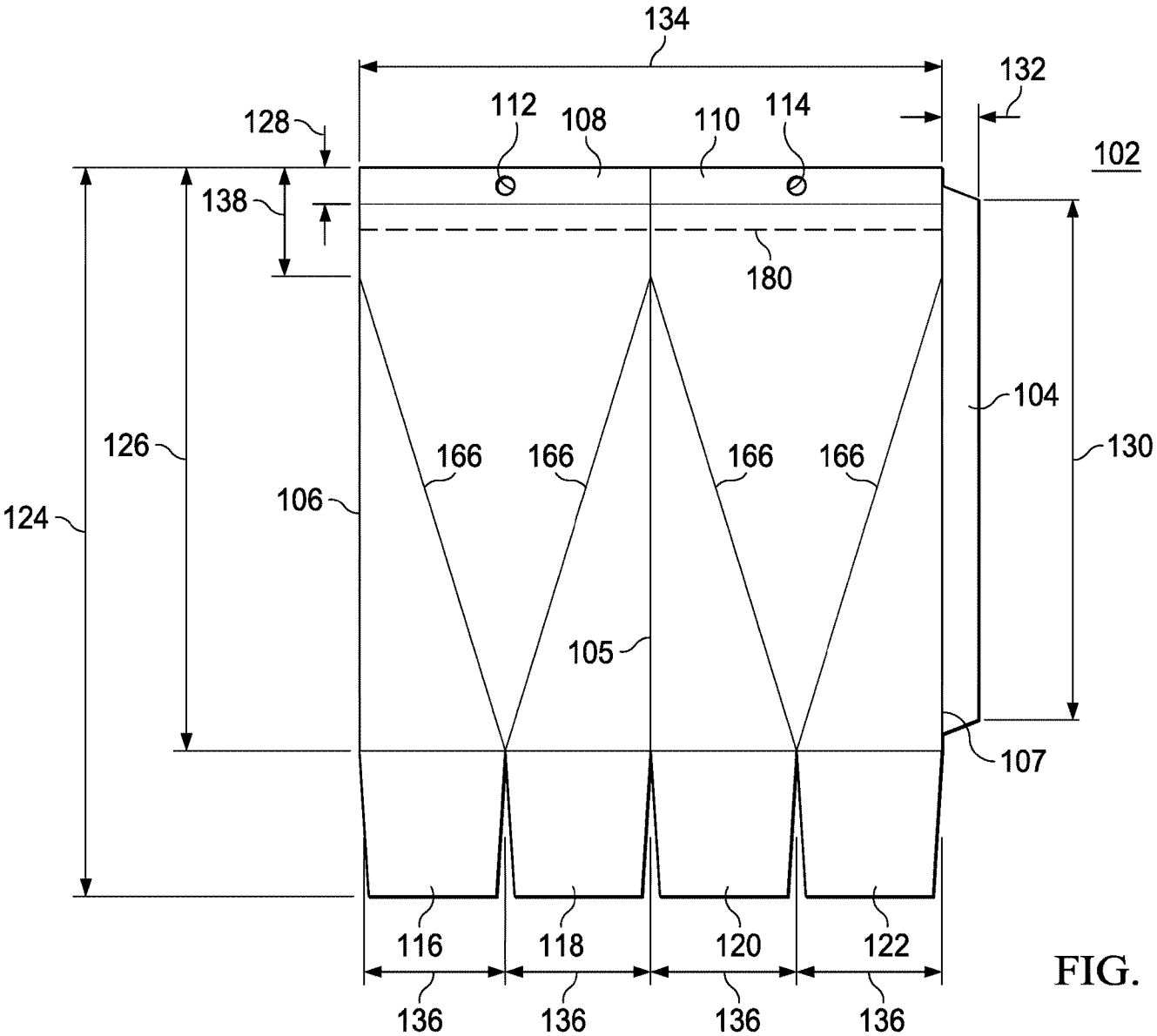
FIG. 1 is a depiction of a paperboard blank used for the constructions of one embodiment of the present invention.

FIG. 1 depicts a paperboard blank used to construct one embodiment of the container. The blank 102 is initially flat and has a front side (depicted in FIG. 1) and a back side (not shown). In construction the front side of a side flap 104 is mated with the back side of the blank 102 along the left side 106 of the blank 102. Further, a left top section 108 and a right top section 110 are mated together. This results in a partially constructed container having the two dimensional top feature with flat end seals consisting of the top portions 108, 110. In one embodiment a hole or opening 112 is made in the top left section 408 and a corresponding hole or opening 114 is made in the top right section 110. When the two top sections 108, 110 are mated, the holes 112, 114 align, thereby giving the product the functionality of having a hole or opening at the top of the container through which a wire rod can be inserted for retail display or vending.

Also shown in FIG. 1 are two "V" shaped creases 166. As used in this detailed description and in the claims of this application, the term "fold" or "folds" means a bend in the blank 102 material of greater than 89 degrees. Further, the term "crease" or "creases" used herein means a bend in the blank 102 material of less than 90 degrees.

In one embodiment of the invention a barrier layer, such as a film consisting of MG bleached kraft, low density polyethylene, aluminum foil, and Surlyn 1652 sealant, is attached to the paperboard blank 102 on the back side of the blank 102 such that when the side flap 104 is sealed to the left side 106, the partially constructed container then has a barrier layer on the interior of the partially constructed container. The paperboard is, in a preferred embodiment, 0.014, 0.015, 0.016, 0.018, or 0.020 caliper paperboard and is SBS, SUS, CCNB, CRB, or some combination thereof. The front of the paperboard includes a graphical treatment that includes, but is not limited to: UV (high gloss) coating, matte coating, registered matte or gloss coating, embossing, and/or debossing. Additionally, specialty inks can be used such as thermochromic and/or phosphorescent inks.

A partially constructed container, as described above, is loaded with a product through the base of the partially constructed container. Such product includes, but is not limited to, bite size savory or sweet snack foods, such as: chips or crisps, nuts, popcorn, hard candy, extruded snacks, puff snacks, fried snacks, baked snacks, fruit pieces, soft candy pieces, chocolate, pretzels, cereals, and mixtures thereof. Once loaded, the construction is completed by fashioning a relatively square base using four bottom or base flaps 116, 118, 120, 122.

Returning to a description of the blank 102, in a preferred embodiment, the distance 124 from the top of the blank 102 to the bottom of the shorter bottom flaps 116, 120 is about 10 inches. The distance 126 from the top of the blank 102 to the top of the bottom flaps 116, 118, 120, 122 is about 8 inches. The distance 128 from the top of the top sections 108, 110 to the bottom of the top sections 108, 110 is about 0.5 inches. The length 130 and width 132 of the side flap 104 is approximately 7.134 inches and 0.5 inches, respectively. The width 134 of the blank 102 less the side flap 104 is approximately 8 inches. The maximum width 136 of the slightly tapered bottom or base flaps 116, 118, 120, 122 is approximately 2 inches, thereby resulting in a square base upon final construction of the container of about 2 inches by 2 inches. The distance 138 from the top of the blank 104 to the top of the "V" shaped creases 166 is between 1 inch and 1.75 inches, and in a preferred embodiment is about 1.5 inches.

Figure 2A:
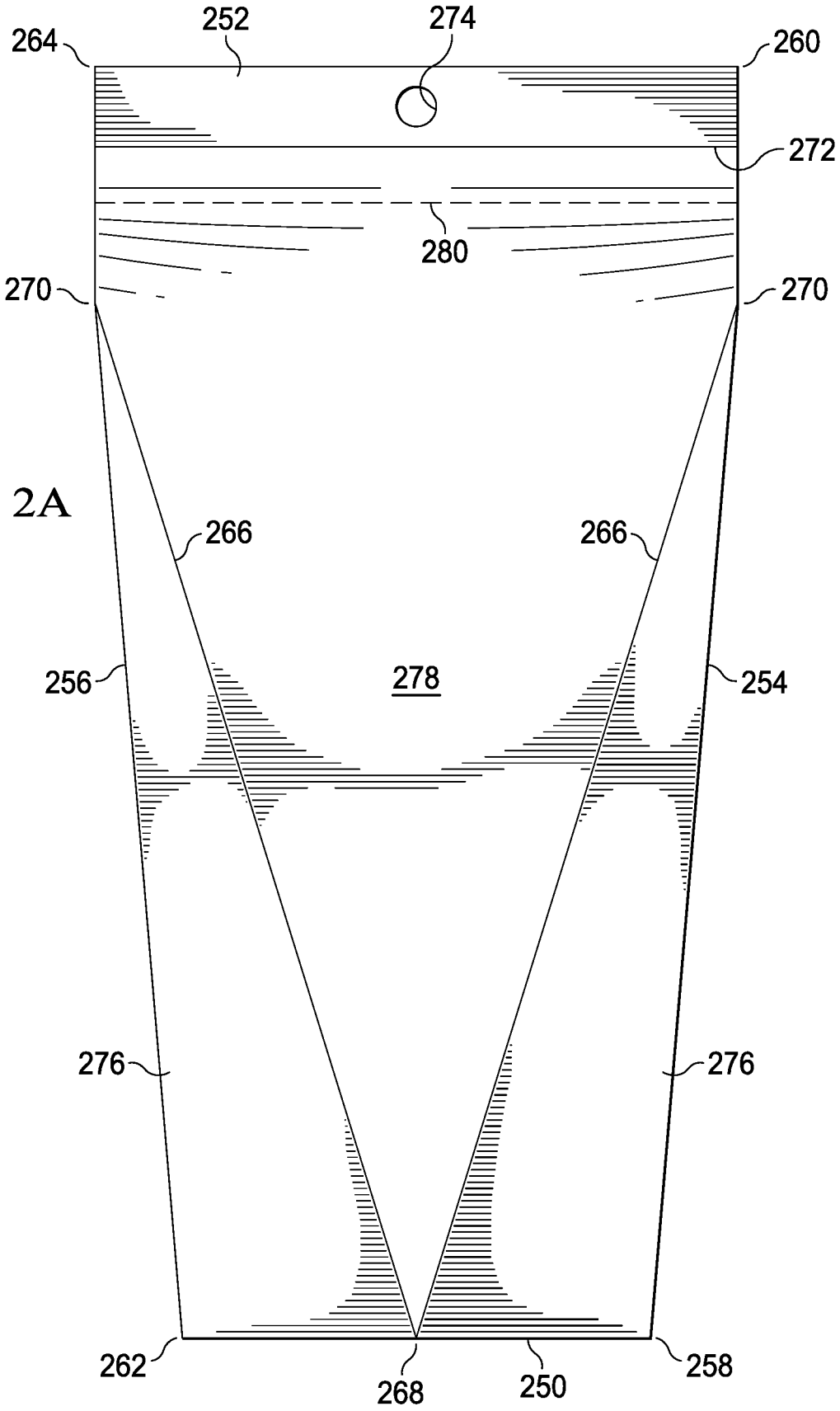
FIGS. 2A, 2B, 2C, and 2D depict one embodiment of the preferred invention after construction.
Figure 2B:
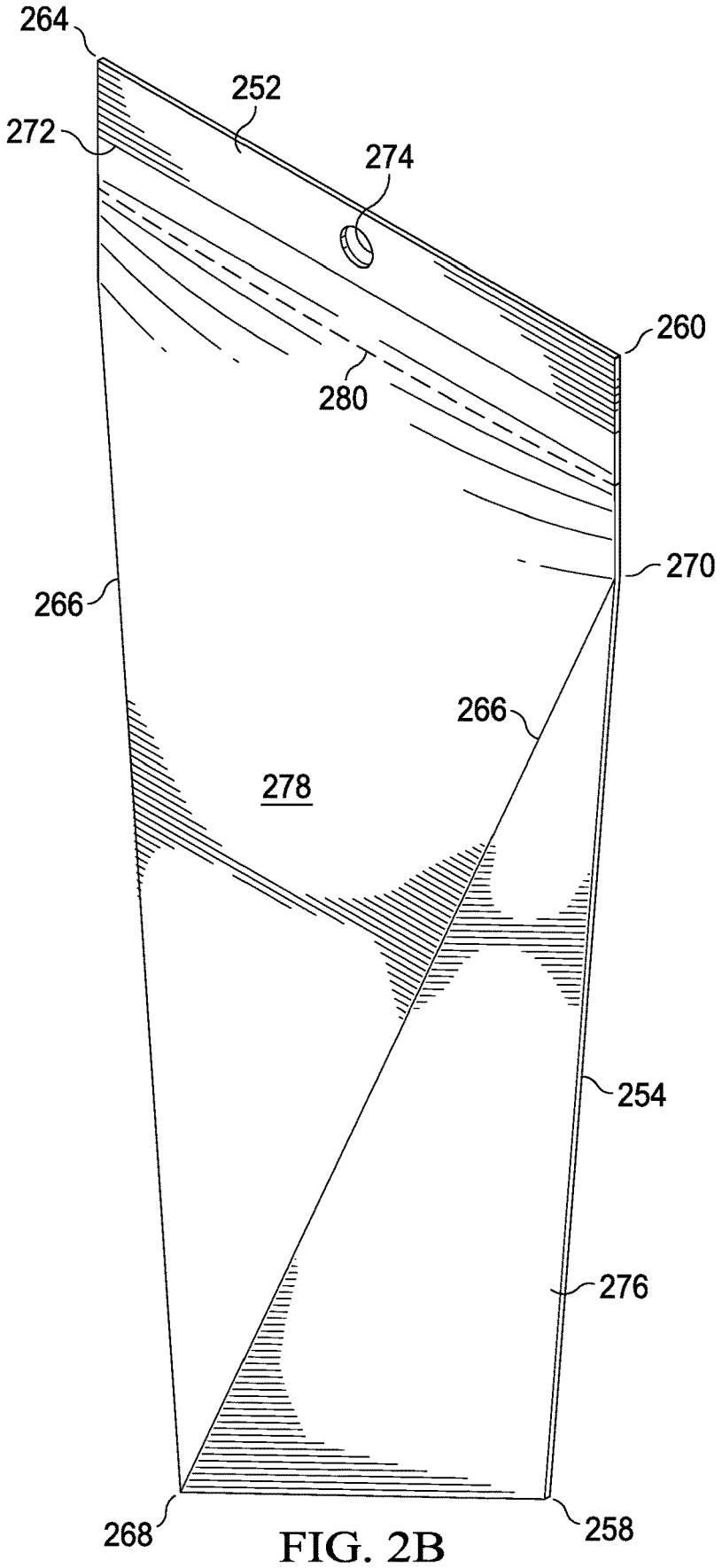
Figure 2C:
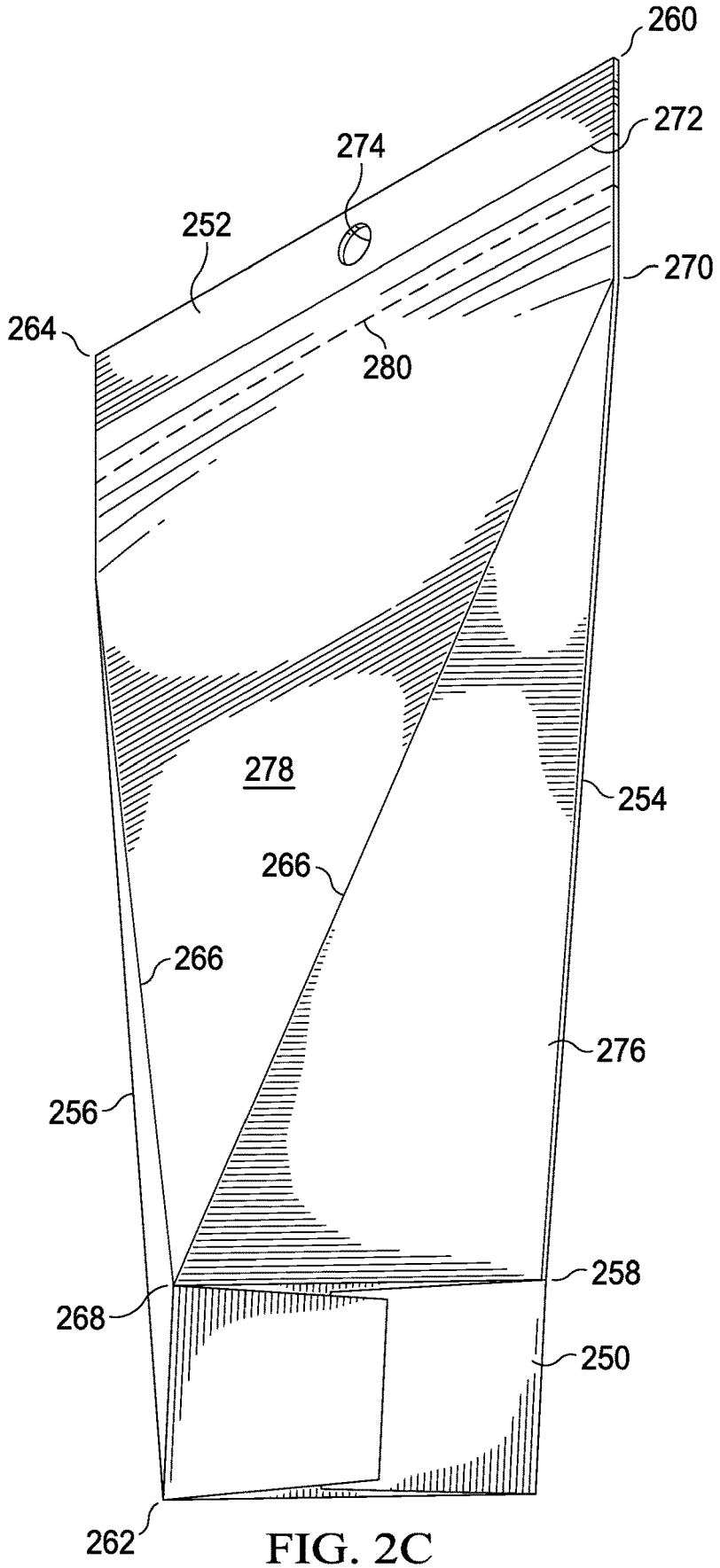
Figure 2D:
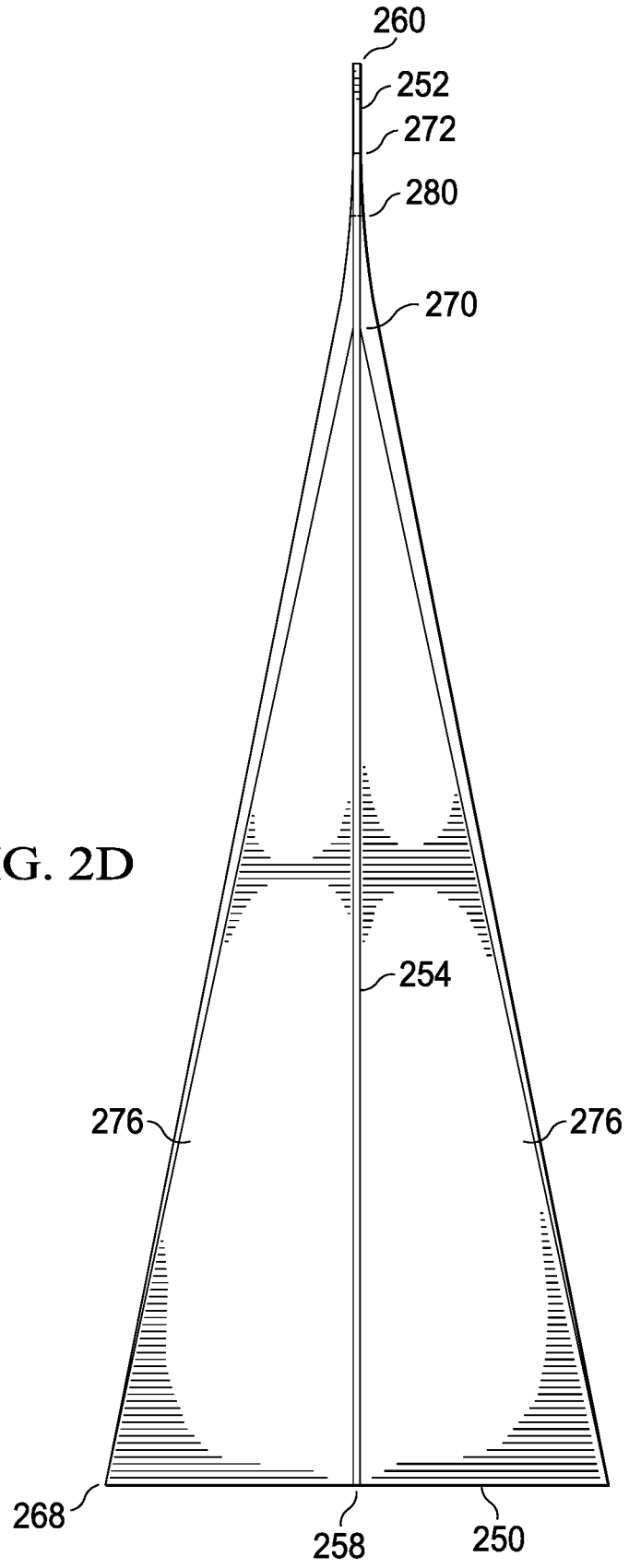

Referring now to FIGS. 2A, 2B, 2C, and 2D, a fully constructed container is depicted. FIG. 2A is a front view of the container. FIG. 2B is a top perspective view of the front, right side of the container. FIG. 2C is a bottom perspective view of the front right side of the container. FIG. 2D is a view of the right side of the container.

When fully constructed the container, in a preferred embodiment consists of a square base 250 and a two-dimensional flat top seal 252. The left side of the container is defined by a left fold 256. The right side of the container is defined by a right fold 254. Thus, the right fold 254 starts at the right corner 258 of the square base 250 and runs to the top right point 260 of the end seal 252. Likewise, the left fold 256 starts at the left corner 262 of the base and runs upward to the top left edge 264 of the top seal 252.

FIG. 2A shows a front view of the container and depicts a "V" shaped crease 266 that starts at the front corner 268 of the square base claim 250 and runs to a point 270 in the horizontal plane that is below the top seal 252 and intersects with the right and left folds 254, 256. An identical geometry as that of the front of the container, depicted in FIG. 2A and described above, is repeated on the back side of the container. Namely, a second "V" shaped crease starts at the rear corner of said base and terminates at the right and left folds 254, 256 at points in the same horizontal plane as the top of the first "V" shaped crease 266 depicted on the front of the container in FIG. 2A.

The container thus has two side walls which are in planar contact with each other above the horizontal crease 272 that defines the bottom of the end seal 252. Also depicted in the end seal 252 is a hole or opening 274. The geometry of the two folds 254, 256 and the two "V" shaped creases 266 provides a container (below the termination points 270 of the top of the "V" shaped creases 266) defined by four right triangle shaped side walls 276 and two isosceles triangle shaped side walls 278.

The embodiment of the container depicted in FIGS. 2A, 2B, 2C, and 2D has a horizontal tear feature 280 along at least one side wall and, in a preferred embodiment, through both side walls, located below the top seal 252 and above the termination points 270 of the top of the "V" shaped creases 266. This tear feature 280 can be a perforation pattern cut partially through the container material, an embedded rip cord in the container, or other modes of separating portions of paperboard known in the art.

The exact dimensions of the formed container can vary from embodiment to embodiment. For example, in a preferred embodiment the dimension of the square base 250 is less than 3 inches by 3 inches. In a more preferred embodiment the dimensions of the square base 250 is about 2 inches by 2 inches. In a preferred embodiment the length of the two folds 254, 256 is less than 10 inches long each and greater than 6 inches long each. In a more preferred embodiment the length of the two folds, 254, 256 is less than 9 inches long each and greater than 7 inches long each. In a preferred embodiment the vertical distance from the top corners 260, 264 of the top seal 252 to the top 270 of the "V" shaped crease 266 is between 1 inch and 2 inches.

Figure 3A:
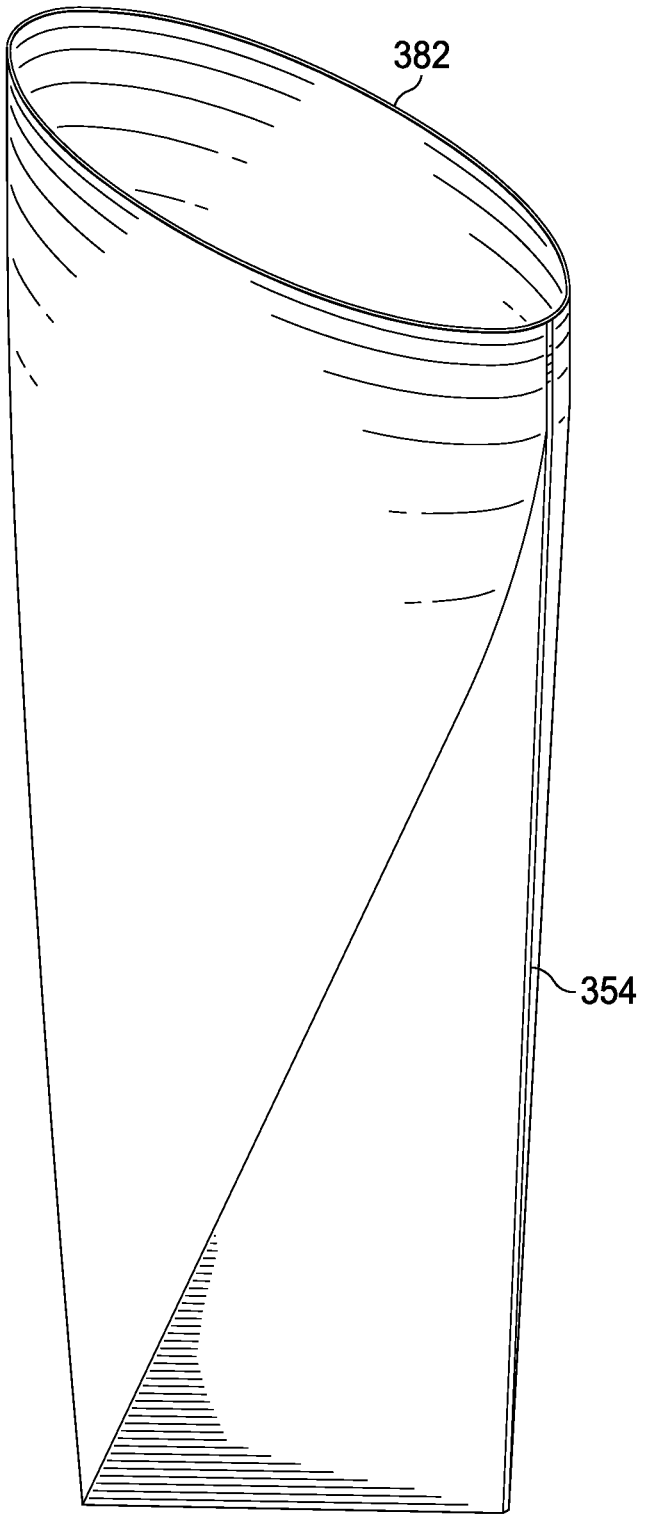
FIGS. 3A and 3B depict one embodiment of the preferred invention with the top seal removed.
Figure 3B:
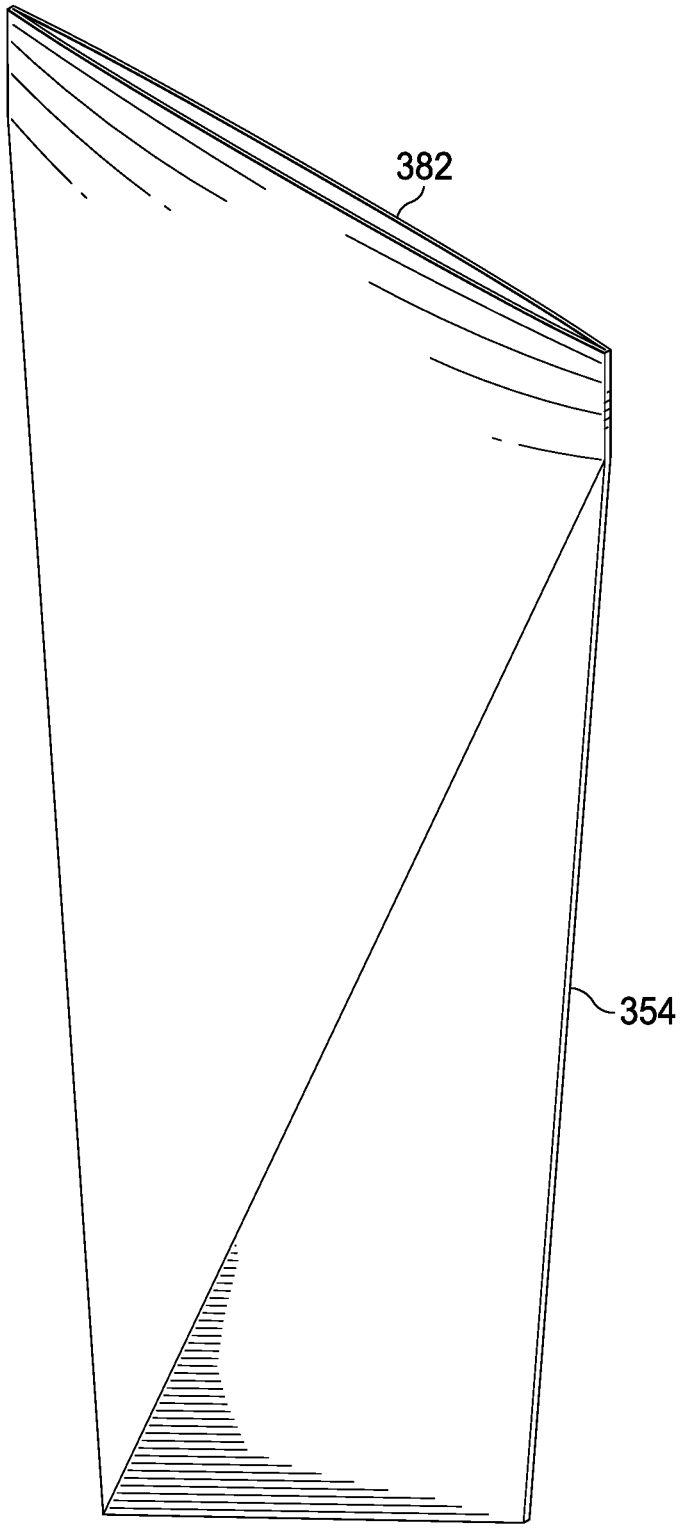

FIGS. 3A and 3B depict the container after the application of the tear feature such that the top has been removed, allowing access to the product found inside. FIG. 3A shows a container that is fully opened at the top, thereby allowing for direct package to mouth consumption of the product. The configuration of the container shown in FIG. 3A occurs when the consumer squeezes the package along the folds 354, thereby opening what becomes the top of the container 382 once the top portion above the tear feature has been removed. Due to the geometric design of the container, when the consumer releases pressure on the folds 354 the container returns to a substantially closed position at the top 382 as depicted in FIG. 3B. This results in the container being predisposed to a substantially closed position when not being squeezed open by a consumer's hand.

Returning to FIG. 1, one method for constructing an embodiment of the container involves first cutting a paperboard blank having a graphics layer on one side and a barrier layer on the other side. Such cutting results in a flat blank having a side flap 104 along one edge and four base flaps 116, 118, 120, 122. The blank 102 is then folded and creased such that there is a fold 105 lengthwise down the middle of the blank and creases 166 that form two "V" shaped creases on either side of the middle fold 105. The two lengthwise edges 106, 107 of the blank 102 are affixed together by use of the side flap 104. A top section 108, 110 of the blank 102 is affixed together thus forming an end seal and resulting in a partially constructed container with an opening in its base.

Once the container is partially constructed it is then filled through the opening in the base with a snack product. Finally, a square base is formed using the four base flaps 116, 118, 120, 122.

The method can include the step of scoring a tear feature 180 near the top of the blank 102. Further, openings can be cut in two locations 112, 114 near the top of the blank 102 such that the openings 112, 114 align upon formation of the end seal, thus forming a single opening through the end seal through which a rod can be inserted for displaying the container in a hanging configuration.

Figure 4:
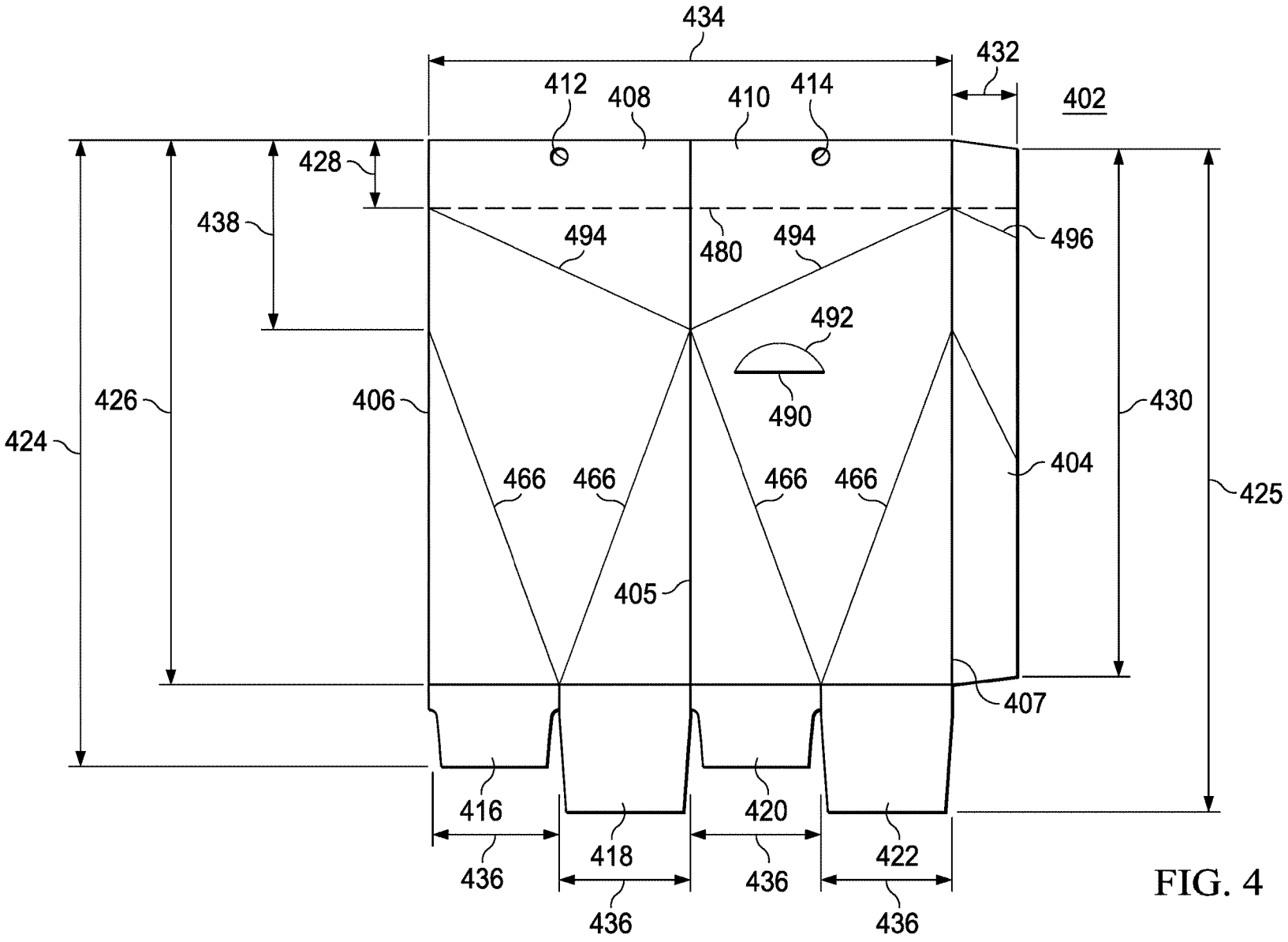
FIG. 4 is a depiction of a paperboard blank used for the construction of an embodiment of the present invention which incorporates a reclose feature.

FIG. 4 depicts a paperboard blank used to construct another embodiment of the container having a reclose feature. The blank 402 is initially flat and has a front side (depicted in FIG. 4) and a back side (not shown). In construction the front side of a side flap 404 is mated with the back side of the blank 402 along the left side 406 of the blank 402. Further, a left top section 408 and a right top section 410 are mated together. This results in a partially constructed container having the two dimensional top feature with flat end seals consisting of the top portions 408, 410. In one embodiment a hole or opening 412 is made in the top left section 408 and a corresponding hole or opening 414 is made in the top right section 410. When the two top sections 408, 410 are mated, the holes 412, 414 align, thereby giving the product the functionality of having a hole or opening at the top of the container through which a wire rod can be inserted for retail display or vending.

Also shown in FIG. 4 are two "V" shaped creases 466. As used in this detailed description and in the claims of this application, the term "fold" or "folds" means a bend in the blank 402 material of greater than 89 degrees. Further, the term "crease" or "creases" used herein means a bend in the blank 402 material of less than 90 degrees.

In one embodiment of the invention a barrier layer, such as a film consisting of MG bleached kraft, low density polyethylene, aluminum foil, and Surlyn 1652 sealant, is attached to the paperboard blank 402 on the back side of the blank 402 such that when the side flap 404 is sealed to the left side 406, the partially constructed container then has a barrier layer on the interior of the partially constructed container. Alternatively, a liner can be inserted into the container after it is partially formed. The paperboard is, in a preferred embodiment, 0.014, 0.015, 0.016, 0.018, or 0.020 caliper paperboard and is SBS, SUS, CCNB, CBR, or some combination thereof. The front of the paperboard includes a graphical treatment that includes, but is not limited to: UV (high gloss) coating, matte coating, registered matte or gloss coating, embossing, and/or debossing. Additionally, specialty inks can be used such as thermochromic and/or phosphorescent inks.

A partially constructed container, as described above, is loaded with a product through the base of the partially constructed container. Such product includes, but is not limited to, bite size savory or sweet snack foods, such as: chips or crisps, nuts, popcorn, hard candy, extruded snacks, puff snacks, fried snacks, baked snacks, fruit pieces, soft candy pieces, chocolate, pretzels, cereals, and mixtures thereof. Once loaded, the construction is completed by fashioning a relatively square base using four bottom or base flaps 416, 418, 420, 422.

Returning to a description of the blank 402, in a preferred embodiment, the distance 424 from the top of the blank 402 to the bottom of the shorter bottom flaps 416, 420 is about 9.5 inches. The distance 425 from the top of the blank 402 to the bottom of the longer bottom flaps 418, 422 is about 10.125 inches. The distance 426 from the top of the blank 402 to the top of the bottom flaps 416, 418, 420, 422 is about 8.25 inches. The distance 428 from the top of the top sections 408, 410 to the bottom of the top sections 408, 410 is about 1.0 inches. A tear feature, 480 such as intermittent cuts through the paperboard but not the underlying liner material, defines the bottom of the top sections 408, 410. The length 430 and width 432 of the side flap 404 is approximately 8.0 inches and 1.0 inches, respectively. The width 434 of the blank 402 less the side flap 404 is approximately 8 inches. The maximum width 436 of the slightly tapered bottom or base flaps 416, 418, 420, 422 is approximately 2.0 inches, thereby resulting in a square base upon final construction of the container of about 2.0 inches by 2.0 inches. The distance 438 from the top of the blank 402 to the top of the "V" shaped creases 466 is between 1.5 inch and 4.0 inches, and in a preferred embodiment is about 3.0 inches.

Also shown is score line 494 extending diagonally from a tear feature 480 to the top of a "V" shaped crease 466. The score line 496 continues on the flap 404 as well. A horizontal cut 490 is located below a score line 494 and within a "V" shaped crease 466. The embodiment shown in FIG. 4 shows an optional score line 492 above the cut 490, said score line 492 in a semicircular pattern.

Figure 5A:
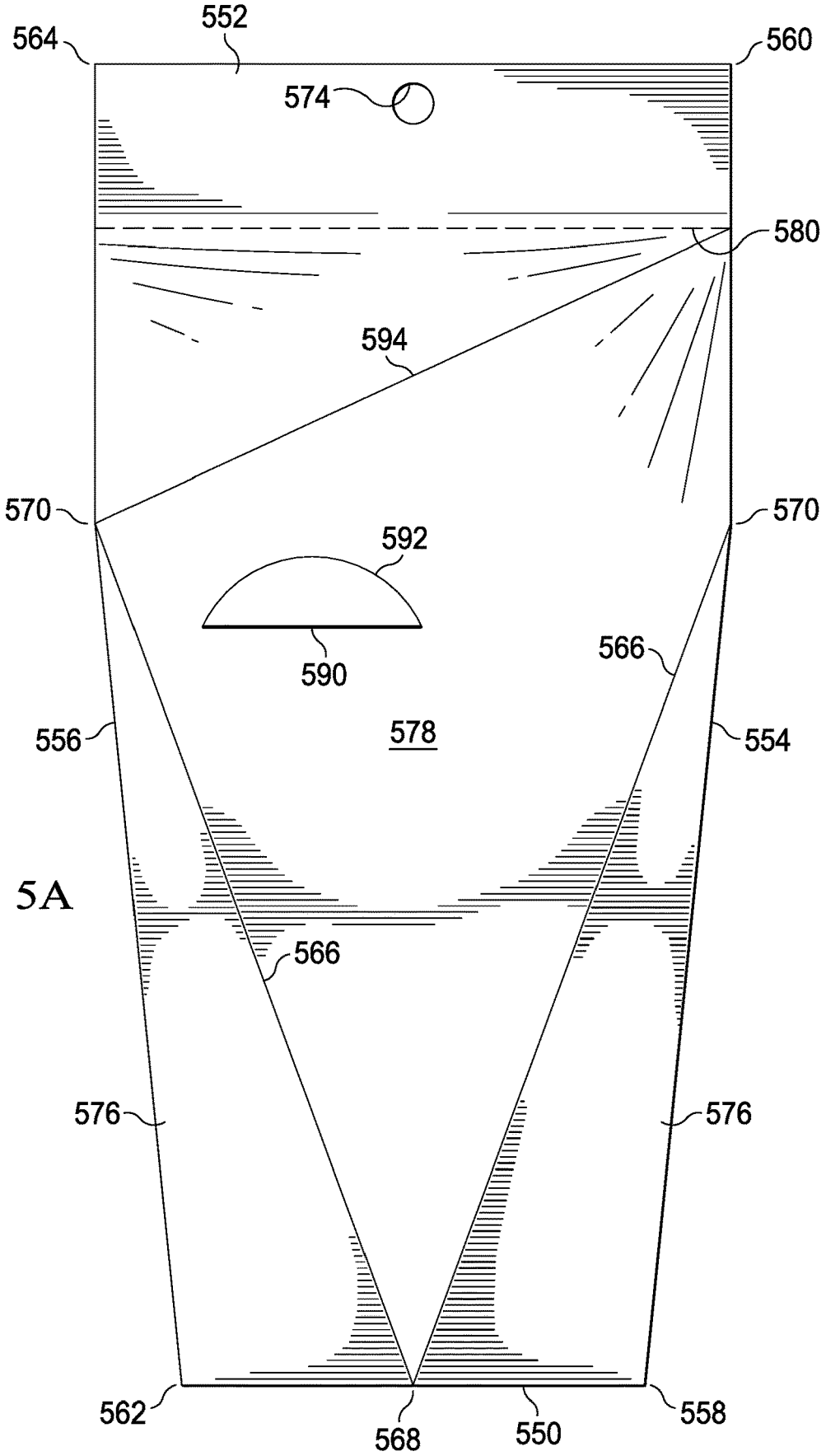
FIGS. 5A, 5B, 5C, and 5D depict an embodiment of the present invention which incorporates a reclose feature after construction.
Figure 5B:
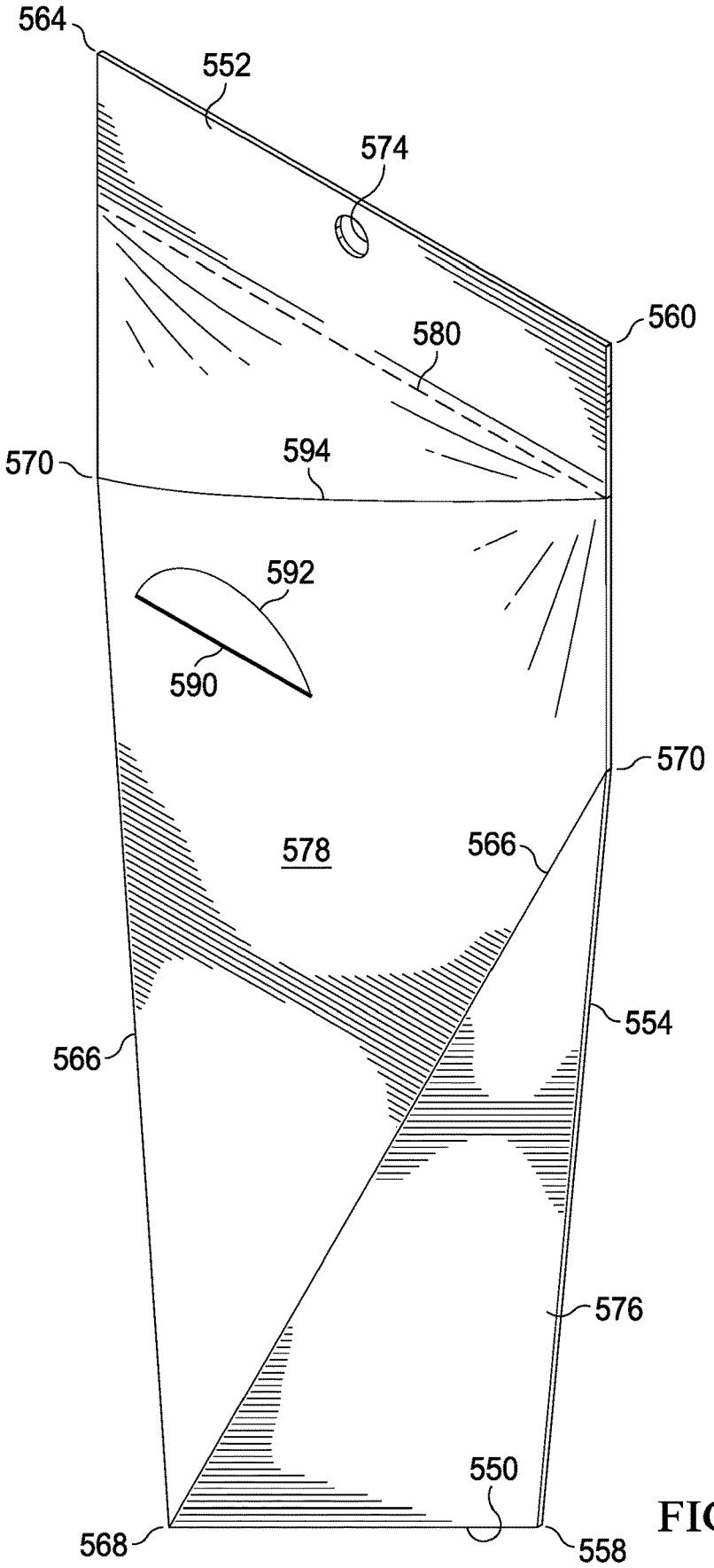
Figure 5C:
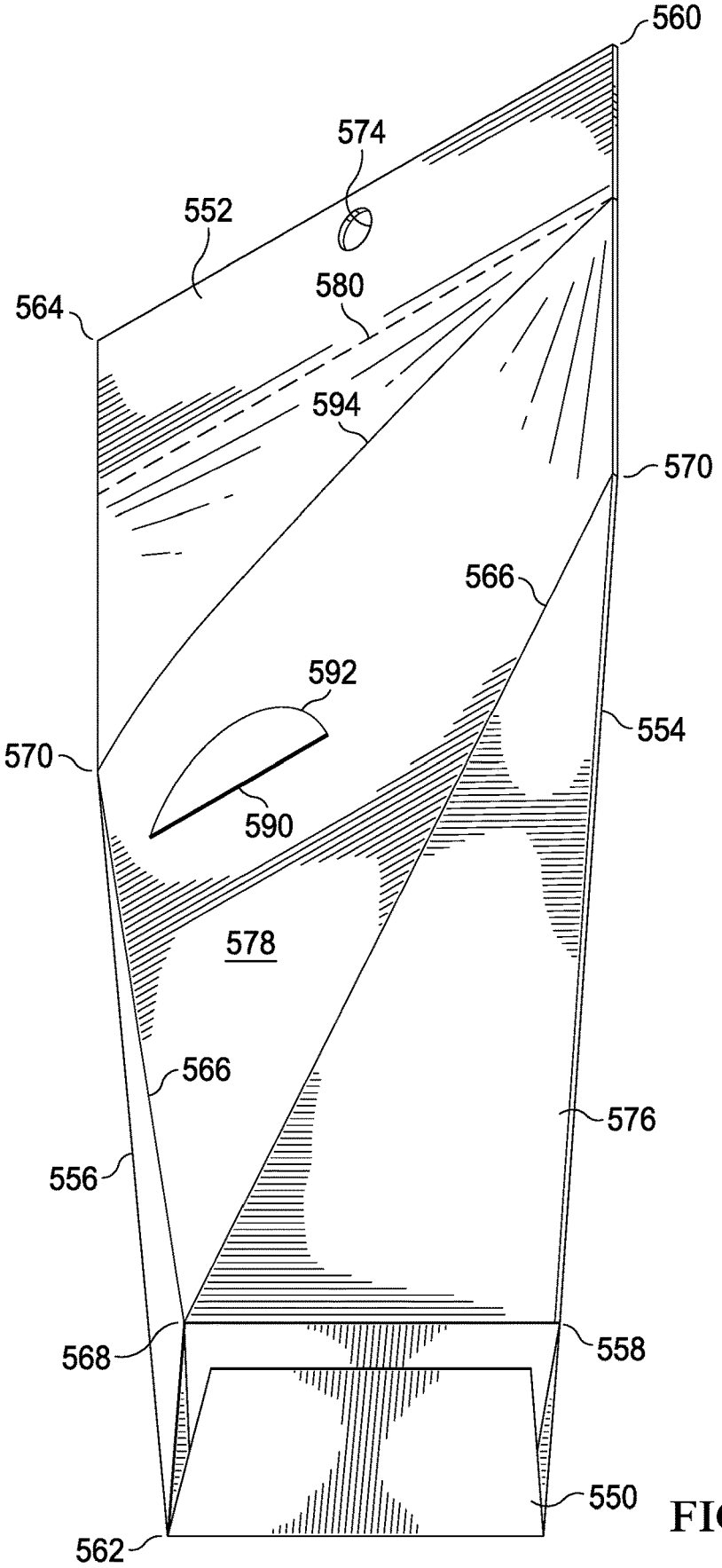
Figure 5D:
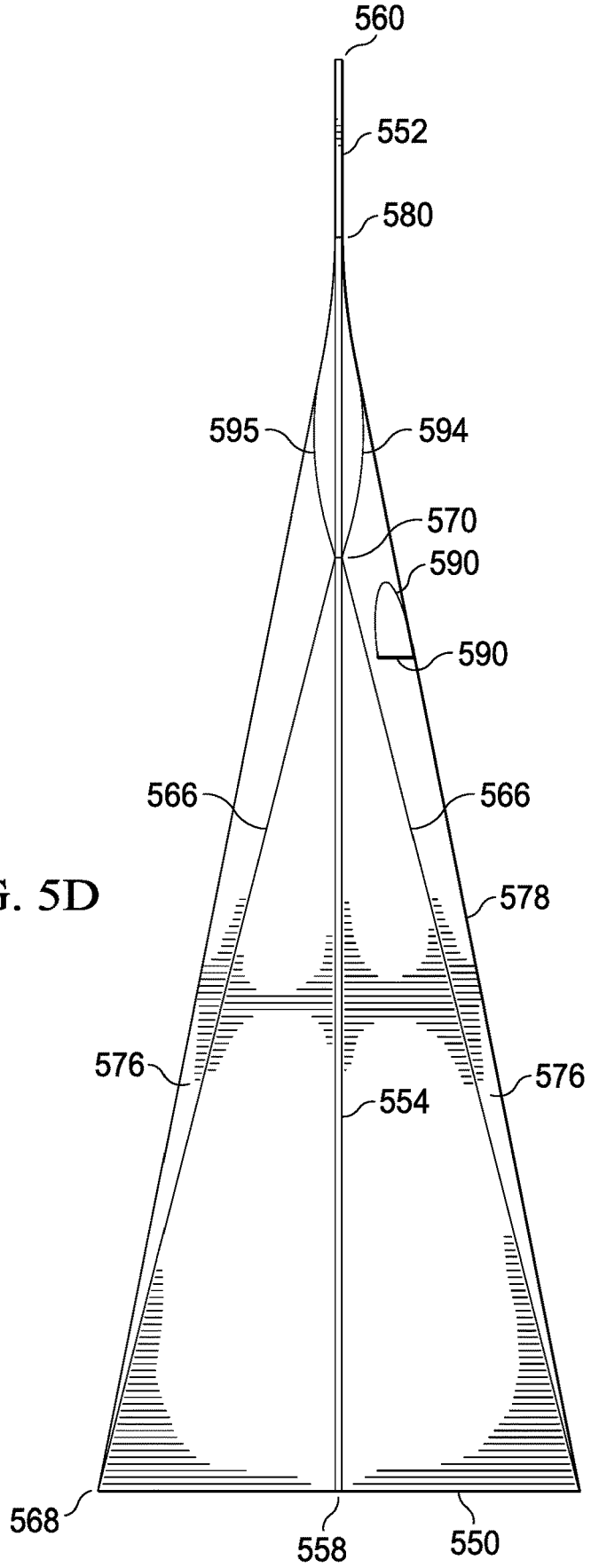

Referring now to FIGS. 5A, 5B, 5C, and 5D, a fully constructed container with a reclose feature is depicted. FIG. 5A is a front view of the container. FIG. 5B is a top perspective view of the front, right side of the container. FIG. 5C is a bottom perspective view of the front right side of the container. FIG. 5D is a view of the right side of the container.

When fully constructed the container, in a preferred embodiment, consists of a square base 550 and a two-dimensional flat top seal 552. The left side of the container is defined by a left fold 556. The right side of the container is defined by a right fold 554. Thus, the right fold 554 starts at the right corner 558 of the square base 550 and extends to the top right point 560 of the end seal 552. Likewise, the left fold 556 starts at the left corner 562 of the base and extends upward to the top left edge 564 of the top seal 552.

FIG. 5A shows a front view of the container and depicts a "V" shaped crease 566 that starts at the front corner 568 of the square base 550 and runs to a point 570 in the horizontal plane that is below the top seal 552 and intersects with the right and left folds 554, 556. An identical geometry as that of the front of the container, depicted in FIG. 5A and described above, is repeated on the back side of the container. Namely, a second "V" shaped crease starts at the rear corner of said base and terminates at the right and left folds 554, 556 at points in the same horizontal plane as the top of the first "V" shaped crease 566 depicted on the front of the container in FIG. 5A. However, in a preferred embodiment, the horizontal cut 590 and accompanying semi-circular cut only appear on the front of the container.

The container thus has two side walls which are in planar contact with each other above the tear feature 580 that defines the bottom of the end seal 552. Also depicted in the end seal 552 is a hole or opening 574. The geometry of the two folds 554, 556 and the two "V" shaped creases 566 provides a container (below the termination points 570 of the top of the "V" shaped creases 566) defined by four right triangle shaped side walls 576 and two isosceles triangle shaped side walls 578.

The embodiment of the container depicted in FIGS. 5A, 5B, 5C, and 5D has a horizontal tear feature 580 along at least one side wall and, in a preferred embodiment, through both side walls, located below the top seal 552 and above the termination points 570 of the top of the "V" shaped creases 566. This tear feature 580 can be a perforation pattern cut partially through the container material, an embedded rip cord in the container, or other modes of separating portions of paperboard known in the art. In a preferred embodiment, the tear feature provides for a clean tear and removal of both the paperboard material of the top seal 552 as well as any liner material sandwiched between the paperboard materials.

Also shown is a horizontal cut 590 through the paperboard material (but not through the liner material). This cut 590 is located below a front score line 594 and within a "V" shape crease 566. There is an optional score line 592 in a semi-circular pattern shown above the cut 590. Again, in a preferred embodiment the cut 590 is only available on one side of the container, whether that be a front or back side. In an alternative embodiment, the cut 590 is a diagonal cut rather than a horizontal cut.

As noted previously, shown is a flat portion defined by the top edge of the container and extending to a horizontal tear feature 580 located above the termination points 570 of the "V" shaped creases 566, wherein below the termination points 570 of the top of the "V" shaped creases 566 the folds 554, 556 and "V" shaped creases 566 define four right-triangle shaped side walls 576 and two isosceles triangle shaped side walls 578, wherein further above the termination points 570 of the top of the "V" shaped creases 566 the container consists of two side walls which are in planar contact with each other above the horizontal tear feature 580, thus forming a top seal and forming a front surface and a back surface, both of said surfaces located above the termination points 570 of the "V" shaped creases 566.

Also shown is a front score line 594 along the front surface running from a first fold 556 to a second fold 554. Not shown (except partially in FIG. 5D) is an identical back score line 595 along the back surface running from the first fold 556 to the second fold 554, wherein the intersectional positions of the front score line 594 at the first fold 554 and the second fold 556 corresponds to the intersectional positions of the back score line 595 at the first fold 556 and the second fold 554, wherein further said vertical location of the intersectional position of each score line 594 at the first fold 556 is different from the vertical position of each score line 594 at the second fold 554. Consequently, while the front score line 594 is illustrated as a diagonal starting at the top 570 of a "V" 566 on the first fold 556 and terminating higher up on the container at the intersection of the tear feature 580 and the second fold 554, the inverse is also contemplated such that the diagonal front score line 594 starts at the higher position on the first fold 556 (at the tear feature 580) and terminates at a lower position 570 on the second fold 554. Thus it can be said that the intersectional position of the score lines 594 along one of the first 556 or second 554 folds is at the intersection of a termination point 570 of the "V" shaped creases and said fold, and that the intersectional position of the score lines 594, 595 along one of the first 556 or second 554 folds is at the intersection of the horizontal tear feature 580 and said fold 554, 556.

Stated differently, shown is a front score line 594 along the front surface starting from the first fold 556 or the second fold 554 at a point below the tear feature 580 and ending at the tear feature 580. A back score line 595 (shown partially in FIG. 5D) runs along the back surface starting from the first fold 556 or the second fold 554 at a point below the tear feature 580 and ending at the tear feature 580, wherein the intersectional position of the front score line 594 at the first fold 556 or the second fold 554 corresponds to the intersectional position of the back score line 595 at the first fold 556 or the second fold 554, wherein further the intersectional position of each score lines 594, 595 at the tear feature 580 is the same. Consequently, the intersectional position of the score lines 594, 595 along one of the horizontal tear feature 580 is the intersection of the tear feature 580 and a first 556 or second fold 554. Likewise, the intersectional position of the score lines 594, 595 along one of the first 556 or second 554 folds is at the intersection of a termination point 570 of the "V" shaped creases and said fold 554, 556. In short, the front and back score lines 594, 595 line up when the container is folded as illustrated in FIGS. 6A and 6B, but the score lines 594, 595 can be oriented differently than depicted in FIGS. 5A, 5B, 5C, and 5D.

The exact dimensions of the formed container can vary from embodiment to embodiment. For example, in a preferred embodiment the dimension of the square base 550 is less than 3 inches by 3 inches. In a more preferred embodiment the dimensions of the square base 550 is about 2 inches by 2 inches. In a preferred embodiment the length of the two folds 554, 556 is less than 10 inches long each and greater than 6 inches long each. In a more preferred embodiment the length of the two folds, 554, 556 is less than 9 inches long each and greater than 7 inches long each, and most preferably about 8.25 inches long. In a preferred embodiment the vertical distance from the top corners 560, 564 of the top seal 552 to the top 570 of the "V" shaped crease 566 is between 1.5 inch and 4.0 inches, and preferably about 3 inches.

Figure 6A:
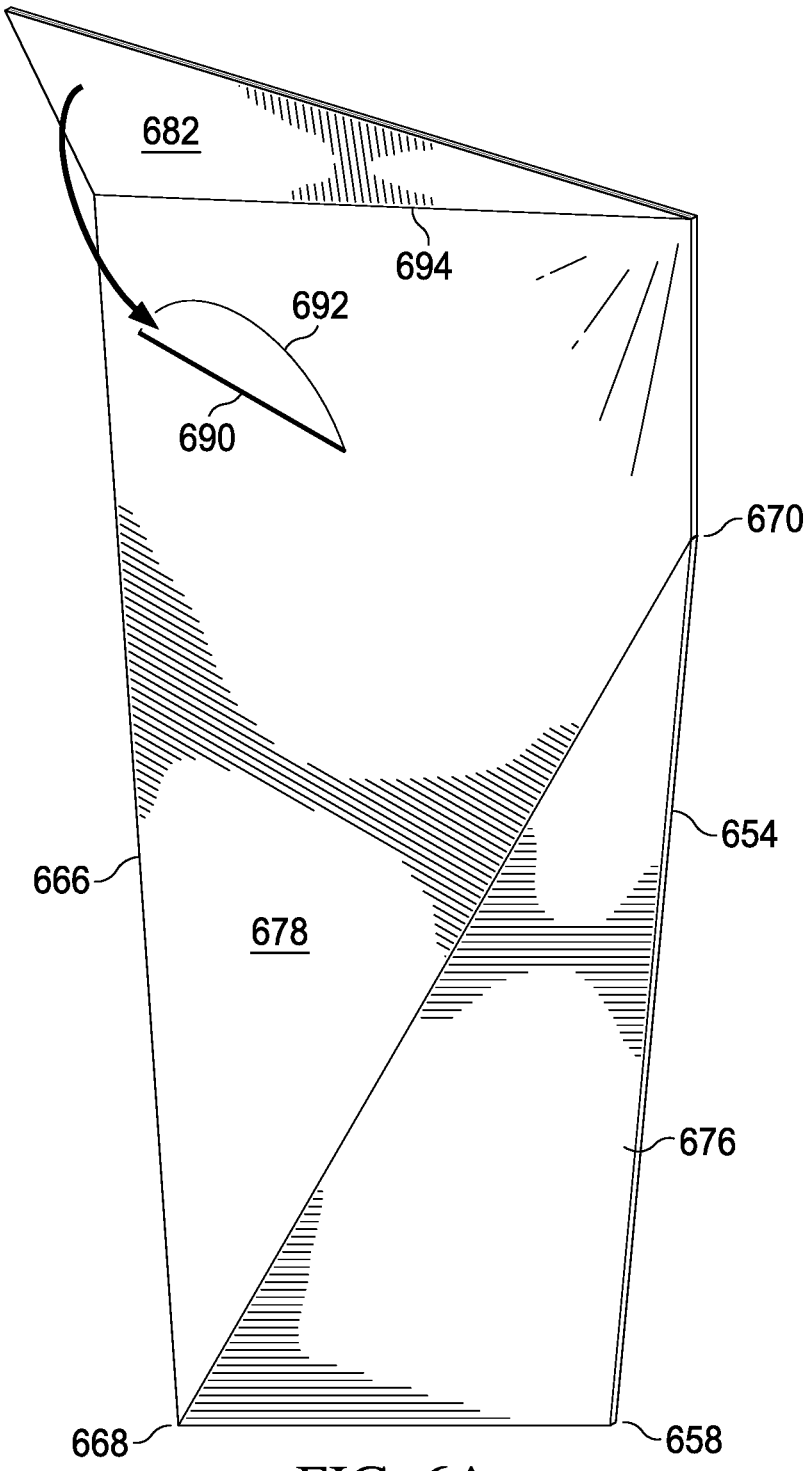
FIGS. 6A and 6B depict the reclose functionality of one embodiment of the present invention.
Figure 6B:
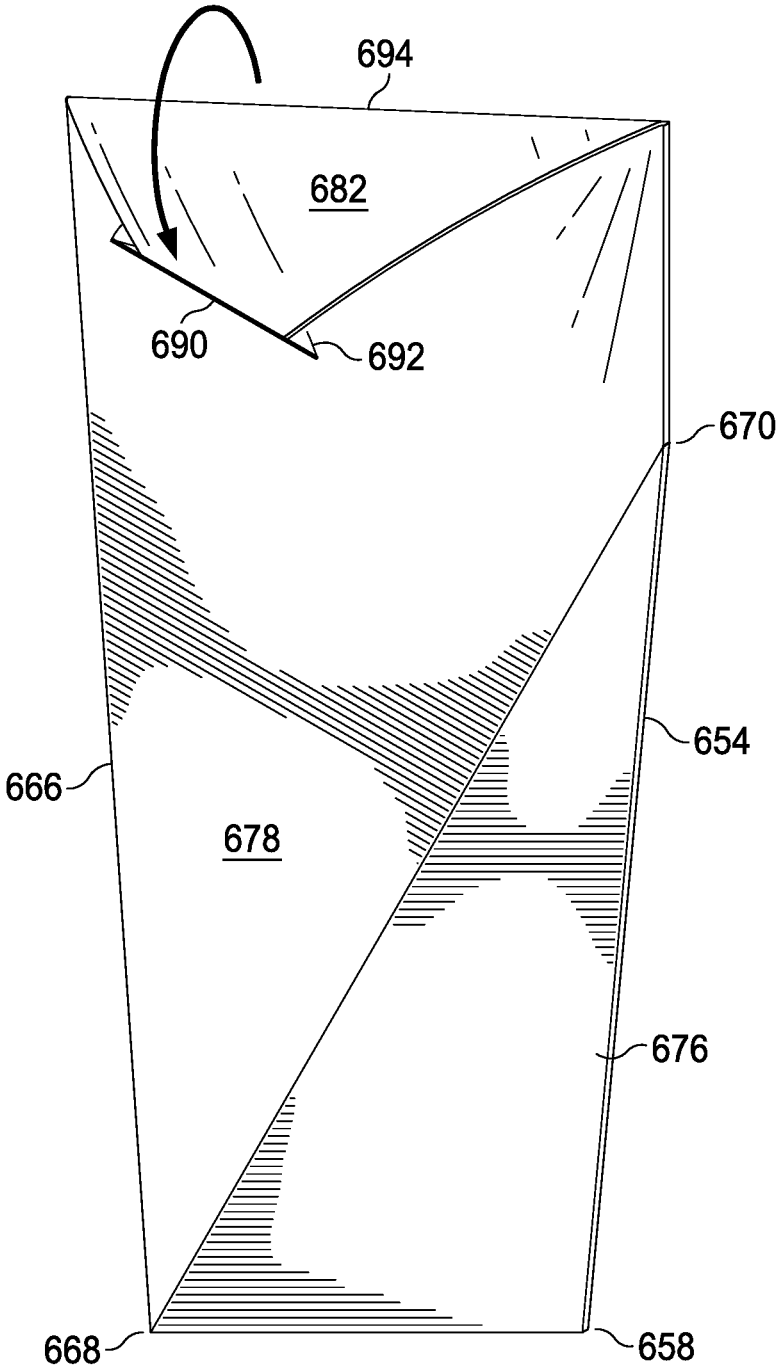

FIGS. 6A and 6B depict the container after the application of the tear feature such that the top has been removed, allowing access to the product found inside. The orientation of FIGS. 6A and 6B are the same as shown in FIG. 5B. Thus elements 658, 666, 668, 670 and 678 correspond to elements 558, 566, 568, 570 and 578, respectively.

FIG. 6A shows a container wherein the remaining portion 682 of the container above the score line 694 is folded downward along the score line 694 toward the cut 690. The semi-circular score line 692 facilities opening the cut 690. FIG. 6B shows the conclusion of this motion as a corner of the remaining portion 682 is inserted into the horizontal cut 690, thereby sealing or reclosing the container. The container can be easily reopened by reversing the steps illustrated in FIGS. 6A and 6B.

The foregoing is merely illustrative of the principles of this invention, and various modifications can be made by those skilled in the art without departing from the scope and spirit of the invention. It should be understood, for example, that the materials used in construction, the methods used to construct the container, and the products that fill the container may vary and are not limited by the specific disclosure stated herein.

We claim:

1. A snack container having a base, side walls, and a top edge, said top edge having a left side and a right side, wherein said container comprising:

a substantially square base, said base having left, right, front, and back corners, wherein the final container is rigid;

a first fold starting at the left corner of said base and terminating at the left side of the top edge of the container;

a second fold starting at the right corner of said base and terminating at the right side of the top edge of the container;

a first "V" shaped crease starting at the front corner of said base and terminating at the first and second folds at points in the same horizontal plane below the top edge of the container;

a second "V" shaped crease starting at the back corner of said base and terminating at the first and second folds at points in the same horizontal plane as the top of the first "V" shaped crease;

a flat portion defined by the top edge of the container and extending to a horizontal tear feature located above the termination points of the "V" shaped creases, wherein below the termination points of the top of the "V" shaped creases the folds and "V" shaped creases define four right-triangle shaped side walls and two isosceles triangle shaped side walls, wherein further above the termination points of the top of the "V" shaped creases the container consists of two side walls which are in planar contact with each other above the horizontal tear feature, thus forming a top seal and forming a front surface and a back surface, both of said surfaces located above the termination points of the "V" shaped creases;

a front score line along the front surface running from the first fold to the second fold;

a back score line along the back surface running from the first fold to the second fold, wherein the intersectional positions of the front score line at the first fold and the second fold corresponds to the intersectional positions of the back score line at the first fold and the second fold, wherein further said vertical location of the intersectional position of each score line at the first fold is different from the vertical location of the intersectional position of each score line at the second fold; and a cut below said front score line and within the first "V" shaped crease.

2. The container of claim 1, wherein the intersectional position of the score lines along one of the first or second folds is at the intersection of the horizontal tear feature and the first or second fold.

3. The container of claim 1, wherein the intersectional position of the score lines along one of the first or second folds is at the intersection of a termination point of the "V" shaped creases and the first or second fold.

4. The container of claim 1, wherein the cut below said front score line is a horizontal cut.

5. The container of claim 1, wherein said container comprises paperboard and a separate interior film.

6. The container of claim 5, wherein said interior film is sealed at the top seal upon construction, thereby enclosing a product, and opened when the top seal is removed from the container at the horizontal tear feature.

7. The container of claim 1, wherein said square base is less than 3 inches by 3 inches.

8. The container of claim 7, wherein said square base is about 2 inches by 2 inches.

9. The container of claim 1, wherein the first or second folds are less than 10 inches long each and greater than 6 inches long each.

10. The container of claim 9, wherein the first or second folds are less than 9 inches long each and greater than 7 inches long each.

11. The container of claim 1, wherein the vertical distance from the top edge to the termination points of the top of the "V" shaped creases is between 1.5 inch and 4.0 inches.

12. A snack container having a base, side walls, and a top edge, said top edge having a left side and a right side, wherein said container comprising:

a substantially square base, said base having left, right, front, and back corners, wherein the final container is rigid;

a first fold starting at the left corner of said base and terminating at the left side of the top edge of the container;

a second fold starting at the right corner of said base and terminating at the right side of the top edge of the container;

a first "V" shaped crease starting at the front corner of said base and terminating at the first and second folds at points in the same horizontal plane below the top edge of the container;

a second "V" shaped crease starting at the back corner of said base and terminating at the first and second folds at points in the same horizontal plane as the top of the first "V" shaped crease;

a flat portion defined by the top edge of the container and extending to a horizontal tear feature located above the termination points of the "V" shaped creases, wherein below the termination points of the top of the "V" shaped creases the folds and "V" shaped creases define four right-triangle shaped side walls and two isosceles triangle shaped side walls, wherein further above the termination points of the top of the "V" shaped creases the container consists of two side walls which are in planar contact with each other above the horizontal tear feature, thus forming a top seal and forming a front surface and a back surface, both of said surfaces above the termination points of the "V" shaped creases;

a front score line along the front surface starting from the first fold or the second fold at a point below the horizontal tear feature and ending at the horizontal tear feature;

a back score line along the back surface starting from the first fold or the second fold at a point below the horizontal tear feature and ending at the horizontal tear feature, wherein the intersectional position of the front score line at the first fold or the second fold corresponds to the intersectional position of the back score line at the first fold or the second fold, wherein further the intersectional position of each score line at the horizontal tear feature is the same; and a cut below said front score line and within the first "V" shaped crease.

13. The container of claim 12, wherein the intersectional position of the score lines along one of the first or second folds is the intersection of the horizontal tear feature and the first or second fold.

14. The container of claim 12, wherein the intersectional position of the score lines along one of the first or second folds is at the intersection of a termination point of the "V" shaped creases and the first or second fold.

15. The container of claim 12, wherein the cut below said front score line is a horizontal cut.

16. The container of claim 12, wherein said container comprises paperboard and a separate interior film.

17. The container of claim 16, wherein said interior film is sealed at the top seal upon construction, thereby enclosing a product, and opened when the top seal is removed from the container at the horizontal tear feature.

18. The container of claim 12, wherein said square base is less than 3 inches by 3 inches.

19. The container of claim 18, wherein said square base is about 2 inches by 2 inches.

20. The container of claim 12, wherein the first and second folds are less than 10 inches long each and greater than 6 inches long each.

21. The container of claim 20, wherein the first and second folds are less than 9 inches long each and greater than 7 inches long each.

22. The container of claim 12, wherein the vertical distance from the top edge to the termination points of the top of the "V" shaped creases is between 1.5 inch and 4.0 inches.

23. The container of claim 1, wherein the base is made up of four base flaps having substantially identical widths.

24. The container of claim 1, wherein the base is made up of four slightly tapered base flaps.

25. The container of claim 12, wherein the base is made up of four base flaps having substantially identical widths.

26. The container of claim 12, wherein the base is made up of four slightly tapered base flaps.

* * * * *